United States Patent [19]

Pfaff

[11] 4,009,625

[45] Mar. 1, 1977

[54] SELF-STRIPPING PUNCH WITH EARS

[75] Inventor: Paul D. Pfaff, Bloomfield Hills, Mich.

[73] Assignee: Bernal Incorporated, Troy, Mich.

[22] Filed: Oct. 24, 1975

[21] Appl. No.: 625,636

[52] U.S. Cl. ..... 83/97; 83/164; 83/684; 83/698

[51] Int. Cl.[2] ..... B26D 7/26; B26F 1/14

[58] Field of Search ..... 83/97, 164, 698, 684, 83/691

[56] References Cited

UNITED STATES PATENTS

| | | | |
|---|---|---|---|
| 576,023 | 1/1897 | Bosworth | 83/691 |
| 739,090 | 9/1903 | Kupfer et al. | 83/97 |
| 863,227 | 8/1907 | Sheldon | 83/97 |
| 1,976,992 | 10/1964 | Hinds | 83/164 |
| 2,526,741 | 10/1950 | Goemaere | 83/164 |
| 2,927,492 | 3/1960 | Porter | 83/698 |

*Primary Examiner*—Willie G. Abercrombie
*Attorney, Agent, or Firm*—Robert G. Mentag

[57] ABSTRACT

A side outlet, self-stripping punch adapted to be mounted in a bore in a die board. The self-stripping punch includes an elongated, cylindrical base having a cutting edge on the top end and a pair of locking ears on the bottom end to prevent rotation of the punch in the die board. The locking ears are formed by upsetting them from the punch base, and they each have a flat face disposed on a common plane passing through the longitudinal axis of the punch.

3 Claims, 4 Drawing Figures

FIG. 1
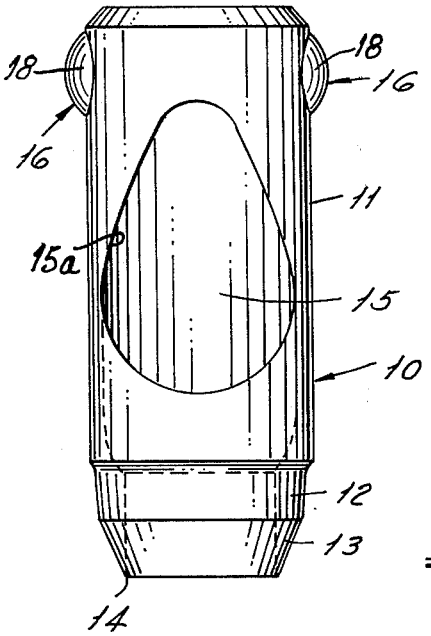
FIG. 2
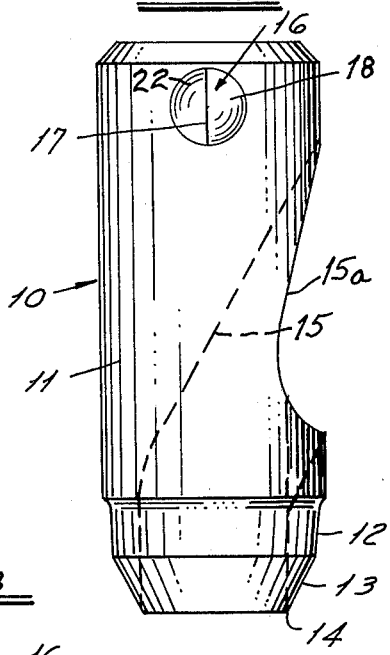
FIG. 3
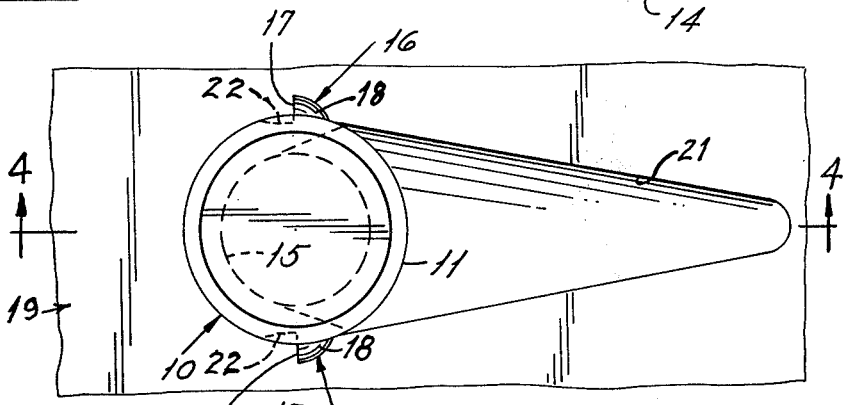
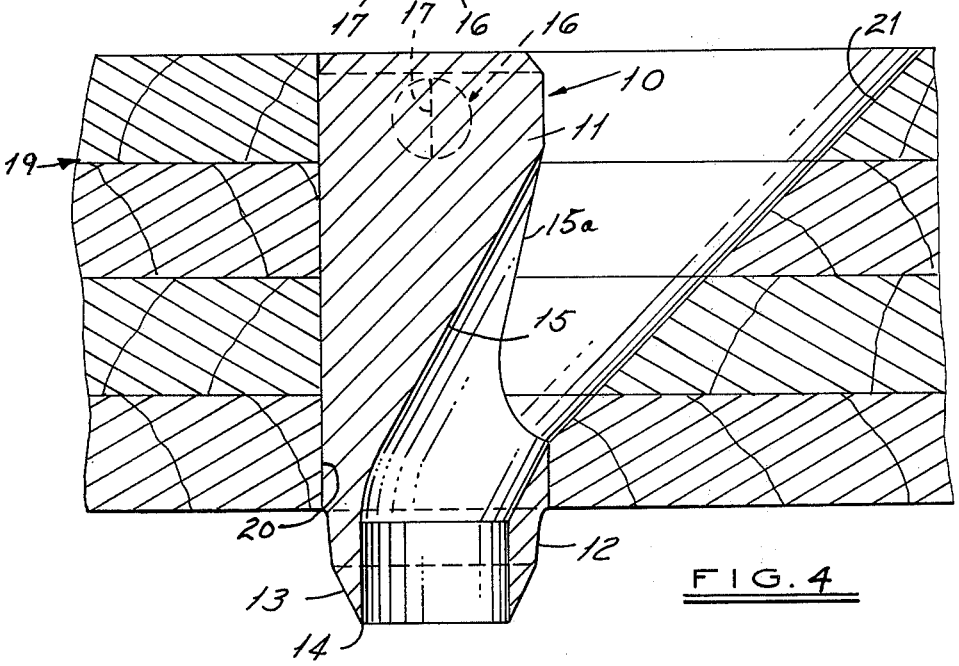
FIG. 4

SELF-STRIPPING PUNCH WITH EARS

SUMMARY OF THE INVENTION

This invention relates generally to the punching art, and more particularly, to a novel and improved side outlet, self-stripping punch provided with locking ears for preventing rotation of the punch in a die board. Heretofore, in order to prevent self-stripping punches from moving, or rotating in a die board, they have been provided with a knurl on the bottom end of the punch for engagement with the wood die board, for retaining the punch in a bore in the die board. A disadvantage of the prior art punches is that when they are driven into a bore in the die board, the knurl tends to open up the bore, whereby the punch has a tendency to loosen in the bore and rotate. The rotation of such prior art punches in the die board causes jamming of the slugs formed by the punch. The slugs normally pass upwardly through an exhaust chute in the punch and then into an exhaust passage in the die board. If they become jammed in said exhaust chute and the die board passage, they can cause machine down time, and labor for repairing the misaligned punch. A further disadvantage of the prior art self-stripping punches with a knurl thereon is that the forming of this type of punch is expensive, since the forming of a knurl on the punch base is expensive and must be carried out by an expensive machine which must be replaced periodically.

In view of the foregoing, it is an important object of the present invention to provide a novel and improved side outlet, self-stripping punch which is constructed and arranged to overcome the aforementioned disadvantages of the prior art self-stripping punches.

It is another object of the present invention to provide a novel and improved side outlet, self-stripping punch which is provided with at least one locking ear, and which is simple and compact in construction, economical to manufacture, and efficient in operation.

It is another object of the present invention to provide a novel and improved side outlet, self-stripping punch which is provided with an elongated, cylindrical body having a cutting edge on the front end thereof, and at least one integral locking ear formed on the periphery of said base adjacent the other end thereof for locking engagement with a die board when the punch is driven into a mounting bore in the die board. The locking ear is preferably formed by upsetting the locking ear from the base of the punch. The locking ear has a flat side and an opposite arcuate web side, whereby the flat side prevents rotation of the punch in the die board. Two of the locking ears can be employed, and in such a case, the flat sides of the locking ears face in the same direction, and they are on a common plane passing through the longitudinal axis of the punch body.

Other features and advantages of this invention will be apparent from the following detailed description, appended claims, and the accompanying drawing.

BRIEF DESCRIPTION OF THE DRAWING

FIG. 1 is an elevational view of a side outlet, self-stripping punch with locking ears, made in accordance with the principles of the present invention.

FIG. 2 is a left-side elevational view of the self-stripping punch illustrated in FIG. 1.

FIG. 3 is a top view of a die board showing the self-stripping punch of FIGS. 1 and 2, operatively mounted therein.

FIG. 4 is an elevational section view of the structure shown in FIG. 3, taken along the line 4—4 thereof, and looking in the direction of the arrows.

DESCRIPTION OF THE PREFERRED EMBODIMENT

Referring now to the drawing, and in particular to FIGS. 1 and 2, the numeral 10 generally designates a side outlet, self-stripping punch made in accordance with the principles of the present invention, from a suitable tool steel, as chrome vanadium oil hardened tool steel. The self-stripping punch 10 includes an elongated cylindrical base or body 11 which has a flat bottom end, and a top flat on cutting edge 14 on the top end. A tapered shoulder is provided on the cutting end of the punch 10, and it comprises a secondary angle 12 and a primary angle 13. The slugs which are cut by the punch 10 pass inwardly through an exhaust chute 15 in the base 11, and outwardly through an outlet hole 15a formed in the side of the base 11.

The numeral 19 in FIGS. 3 and 4 designate a conventional die board which is made from any suitable material, as for example, wood as plywood. The punch 10 is shown as being mounted in a punch hole 20, which is formed transversely through the die board 19. The slugs are adapted to pass upwardly through the exhaust chute 15, and out through the exhaust chute opening **15*a*, and thence upwardly through a grooved ejection opening passage 21 formed in the die board 19**.

As shown in FIGS. 1, 2 and 3, the self-stripping punch 10 is provided with a pair of diametrically disposed locking ears, generally indicated by the numeral 16 on the periphery of the punch base 11. The locking ears 16 are formed by upsetting the material on the opposite sides of the punch base 11, near the bottom end thereof. The upsetting action is taken on one side only of each of the ears 16, and on said one side the upsetting action provides a flat face 17. The opposite sides of each of the locking ears 16 is an arcuate web, as indicated by the numeral 18, which provides a strong locking ear. The upsetting action also cuts out a portion 22 from the punch body 11.

In use, the punch 10 is driven into a mounting hole, as 20, in the die board 19, together with other punches for automatically punching a desired number of holes in a workpiece. The locking ears 16 are driven into the wood of the board 19 and they function to retain the punch 10 in an operative position in the die board 19, in alignment with the grooved ejection passage 21. The two flat faces 17 on the pair of locking ears 16 are disposed on a common axis that passes the longitudinal axis of the punch 10. The flat faces 17 of the locking ears face in the same direction, and they function to prevent the punch 10 from turning or rotating in the mounting hole 20, in the die board 19.

The punch 10 is adapted for punching holes in nonferrous non-metallic materials, such as rubber, an asbestos material, vinyl, and the like. The slugs cut from a workpiece pass upwardly through the exhaust chute 15 in the punch body 11, and thence out through the discharge hole 15a and through the grooved ejection passage 21.

While it will be apparent that the preferred embodiment of the invention herein disclosed is well calculated to fulfill the objects above stated, it will be appreciated that the invention is susceptible to modification, variation and change.

What is claimed is:

1. In a side outlet, self-stripping punch for mounting in a die board, the combination comprising:

a. a cylindrical, elongated punch base provided with a cutting edge on the top end thereof;

b. at least one integral locking ear formed on the periphery of the punch, adjacent the bottom end of the punch, for retaining the punch against rotation in a die board;

c. said locking ear being provided with a flat face on one side thereof which is disposed on a plane that passes through the longitudinal axis of the punch; and, d. said locking ear being formed on the other side thereof in the form on an arcuate web.

2. A side outlet, self-stripping punch as defined in claim 1, wherein:

a. two integral locking ears are provided on the periphery of the punch, with the flat faces being disposed on a common plane that passes through the longitudinal axis of the punch.

3. A side outlet, self-stripping punch as defined in claim 2, wherein:

a. the flat faces of the locking ears are formed so that they both face in the same direction.

* * * * *

UNITED STATES PATENT OFFICE

CERTIFICATE OF CORRECTION

Patent No. 4,009,625 Dated March 1, 1977

Inventor(s) Paul D. Pfaff

It is certified that error appears in the above-identified patent and that said Letters Patent are hereby corrected as shown below:

Claim 1, item (d), line 2, "on" should read --of--.

Signed and Sealed this

Tenth Day of May 1977

[SEAL]

*Attest:*

RUTH C. MASON
*Attesting Officer*

C. MARSHALL DANN
*Commissioner of Patents and Trademarks*